United States Patent [19]

Lowenthal et al.

[11] Patent Number: 4,800,380

[45] Date of Patent: Jan. 24, 1989

[54] MULTI-PLANE PAGE MODE VIDEO MEMORY CONTROLLER

[75] Inventors: Richard W. Lowenthal, Los Gatos; Larke E. Reeber, Freemont; Drew S. Hoffman, Campbell; Michael Ramsay, Los Altos, all of Calif.

[73] Assignee: Convergent Technologies, San Jose, Calif.

[21] Appl. No.: 452,000

[22] Filed: Dec. 21, 1982

[51] Int. Cl.[4] ..... G09G 1/16

[52] U.S. Cl. ..... 340/750; 340/799; 340/703

[58] Field of Search ..... 340/750, 798, 799, 703, 340/749, 747, 802

[56] References Cited

U.S. PATENT DOCUMENTS

| | | | |
|---|---|---|---|
| 4,445,115 | 4/1984 | Rudgard | 340/750 |
| 4,446,457 | 5/1984 | Alexander | 340/750 |
| 4,451,825 | 5/1984 | Hall et al. | 340/750 |
| 4,454,593 | 6/1984 | Fleming et al. | 340/750 |
| 4,509,043 | 4/1985 | Mossaides | 340/703 |

OTHER PUBLICATIONS

*Architecture of an Electronic Book,* Murray et al., IEEE Trans. on Ind. Elec., vol. IE-29, No. 1, 2/82, pp. 82-91.

*Primary Examiner*—Marshall M. Curtis
*Attorney, Agent, or Firm*—Townsend & Townsend

[57] ABSTRACT

A page mode memory controller for a multi-plane color video display providing three bits/pixel corresponding to three page partitioning in each of sixteen 64K dynamic RAMs is described. The three bits/pixel are routed to a color lookup table to provide a choice of eight colors from a palette of 64 colors. Graphic display information is combined with alphanumeric video information on a pixel-by-pixel basis. The combined graphic-/alphanumeric information is then converted from a digital signal to an analog signal. Page mode reads access three color planes for video display cycles using a counter for the two least significant memory column address bits. To create the displayed image, vectors are drawn three times, once at each plane.

21 Claims, 11 Drawing Sheets

RA0+ - RA3+
CHWE-
GRWE-
ATTEN-
R3PULLUP
WAIT-
VSYNCD 2+
CASTOGGLE+
+5V
R2
1K
45
74LS38
74S240
44
43
R
CI
74LS273
CTRDIV 16
CT-0
C3
74LS193
42
+5W
R3
1K

| FIG. 5A. | FIG. 5B. |
|---|---|

MULTI-PLANE PAGE MODE VIDEO MEMORY CONTROLLER

BACKGROUND OF THE INVENTION

1. Field of the Invention

The present invention relates to multi-plane video displays. More particularly, the present invention relates to a page mode memory controller for providing a plurality of display planes during each image memory access cycle.

2. Description of the Prior Art

The desire to convert data into graphic forms that can be readily manipulated is making graphics capabilities a requirement of many computer customers. Providing color in a product is even more desirable because color adds clarity throughout a presentation and emphasizes key points.

An inexpensive and easy way to add graphics-like functions to an existing design is to enhance the character set by adding one or more ROMs or PROMs. Line drawing sets are created this way, as are some of the "graphics" on personal computers. For simple forms generation or very simple bar charts this approach may be adequate. Adding character set memory requires little or no redesign of the alphanumeric display structure and is therefore quick to implement. But it is also inflexible since only predesignated graphic symbols are available—no combining or overlaying of the symbols is possible.

To increase flexibility, a RAM-based character set with an option to reload the character set or add more RAM for "user-defined" characters is often used. This allows a user the flexibility necessary to design charater cells that fit specific applications. For simple bar charts and pictures, where the necessary character cells are repetitive, this is usually sufficient. For more complex pictures, where the frequency of repetition of character cells is lower, the user may not have enough unique characters to complete the picture or graph. If there are not enough unique characters, the user must simplify the chart, leaving out potentially valuable detail. To guarantee a sufficiently large number of unique characters requires a large RAM array with a short access time, thus eliminating the cost advantage of this structure.

Because of the problems associated with making enhanced character mode displays work for even moderately complex pictures and graphs, most raster-scan graphic implementations are bit-mapped. In a bit-mapped graphics system, displaying complex pictures and graphs containing a lot of information is no more difficult than displaying simple pictures and graphs containing little information.

In a bit-mapped graphics system, a RAM array having a one-to-one correspondence with the visible image on the display is used to store the graphic image. The array must be controllable in two ways. First, the data in the array must be read and sent to the CRT or other raster display. Second, the array must be modifiable so that storing a picture or graph is not difficult. Some bit-mapped graphics systems are organized as dual-port memories having one address port for the display addressing and another port for image generation. Most systems share a single address port with one function having priority.

The design of a controller for a graphics bit map system requires an understanding of the overall system function. Graphics systems must to be able to take objects and modify them and their characteristics on a display. Objects may be structured, that is, contain other objects, or they may be simple collections of vectors, arcs, and other primitive elements. These primitives must be manipulated to translate (move horizontally and vertically), rotate, scale (change the relative size on the screen), and clip (delete invisible portions) the objects as the image is moved about on the screen. Once the vectors or arcs that are to be displayed are determined, such information is converted into locations and data to be written. The process of converting vector information to raster RAM addresses is known as "vector-to-raster" conversion.

There are numerous ways to partition the sequence of tasks associated with conversion of data to pictures or charts. The most common way accomplishes all computations with one processor. For large mainframe systems the host computer does all the computations and a "dumb terminal" holds the display. Personal computers take a similar approach on the opposite end of the scale. All system functions, including all levels of graphic functions, are done with a MOS microprocessor.

Other partitioning include using a general purpose MOS microprocessor to handle system functions while a specialized finite state machine controls a set of registers, counters, and adders that handle vector-to-raster conversion. This approach adds a first level of pipelining that increases throughput, but it also increases the amount of hardware needed. Substituting a MOS microprocessor to handle low level graphics manipulation—in addition to vector-to-raster conversion—increases system flexibility and potential capability with little sacrifice in system speed. Substituting a bipolar bit-slice processor for either microprocessor increases throughput proportional to the increased processing speed. A problem with this approach is that bit-slice processor systems typically require excessive space and power.

Providing three levels of pipelining by separating vector-to-raster conversion/vector transformation from other system functions, has a similar effect—an increase in speed, but an additional space and power penalty. In general, all previously known approaches are less than satisfactory because they use general purpose ICs and processors, which are optimized for functions other than graphics.

SUMMARY OF THE INVENTION

The present invention is a page mode memory controller for a multi-plane color video display. In an exemplary embodiment, the invention use sixteen 64K dynamic RAMs and provides three bits/pixel each bit corresponding to a separate memory plane. The three bits/pixel are routed to a color lookup table that provides a choice of eight colors out of a palette of 64 possible display colors. The graphic/color display information is combined with alphanumeric video information on a pixel-by-pixel basis. The combined graphic-/alphanumeric information is then converted from a digital signal to an analog signal and finally displayed.

An NEC 7220 graphics control integrated circuit interfaces directly to a microcomputer bus and controls a bit-mapped graphic display image memory. Drawing a vector or arc requires sending a series of commands and parameters which describe the item to be drawn. The 7220 draws the vector during available memory cycles, indicating the data and address to be written. The 7220 is operated in slave mode to synchronize it to an Intel 8275 CRT Controller, which generates an alphanumeric display.

The present invention provides a method for accessing three color planes. The 7220 cannot manipulate more than one bit/pixel on any memory cycle, although color plane selection requires two or more bits/pixel. In the present invention, the graphic display memory is organized as a linear array of pixels with each of the three planes contiguous one to the other. Page mode reads access three color planes for video display cycles using a counter for the two most significant memory column address bits. To create the displayed image, vectors are drawn three times, once at each plane.

When a video memory cycle is complete, data are loaded into three parallel-to-serial shift registers where each pixel is shifted out to the color look-up table, an 8×6-bit RAM. The output of the lookup table is resynchronized on a pixel by pixel basis.

BRIEF DESCRIPTION OF THE FIGURES

FIGS. 6, 6A and 6B are schematic diagrams of a multi-plane graphic image memory shift register according to the present invention.

DETAILED DESCRIPTION OF A PREFERRED EMBODIMENT

The herein described invention is a page mode memory controller for use in a multi-plane color video display. The present invention partitions or paginates a standard 64K dynamic random access memory (RAM) to produce a plurality of data planes at each display pixel location. The disclosed embodiment of the invention provides three planes of data in the form of three bits at each display pixel location. In this way, a color selection of eight possible colors is provided at each pixel location ($2^3=8$).

Figure 1:
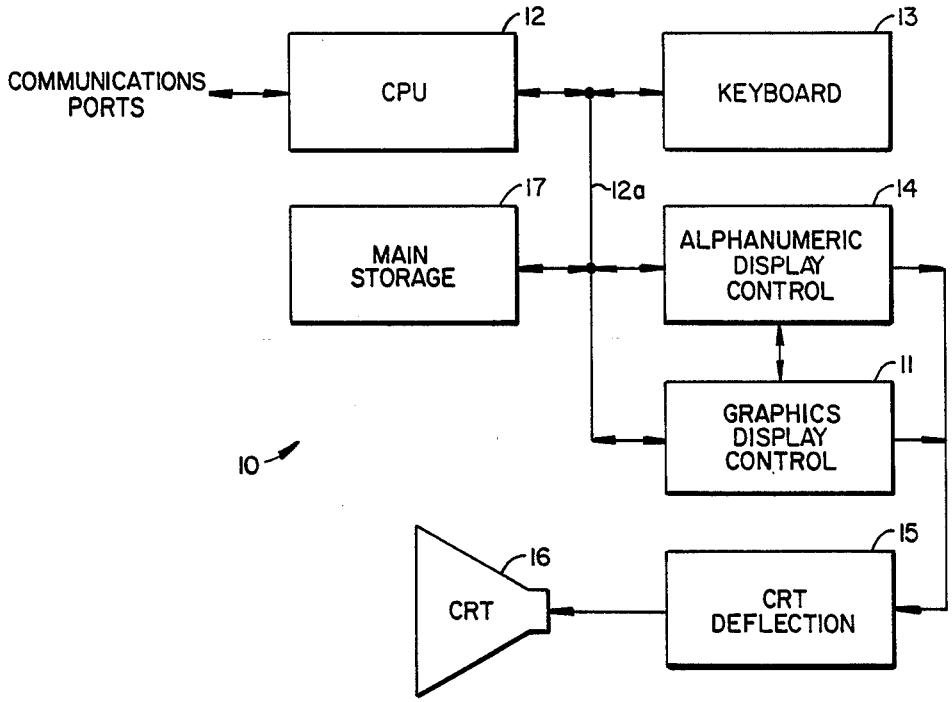
FIG. 1 is a block diagram of a color work station into which the present invention is incorporated.

The present invention finds application in a color work station or terminal for a computer system. FIG. 1 shows in block form the architecture of a typical computer system work station 10. A work station central processing unit (CPU) 12 is shown having connections for receiving data via serial and parallel communication ports. The CPU controls work station operation by sending and receiving data and address information over a system bus 12*a*. User input is provided by a keyboard 13 and information (data) is stored in a main storage unit 17.

A computer work station of the type in which the present invention finds application provides both alphanumeric display information and graphic display information. An alphanumeric display control circuit 14 is provided for displaying text, numbers, and the like; a graphics display control circuit 11 is provided for displaying charts graphs, etc.; and representation of alphanumeric and graphic data is defined according to a predetermined display priority. Data to be displayed are provided to a CRT deflection circuit 15 which drives a CRT 16.

Figure 2:
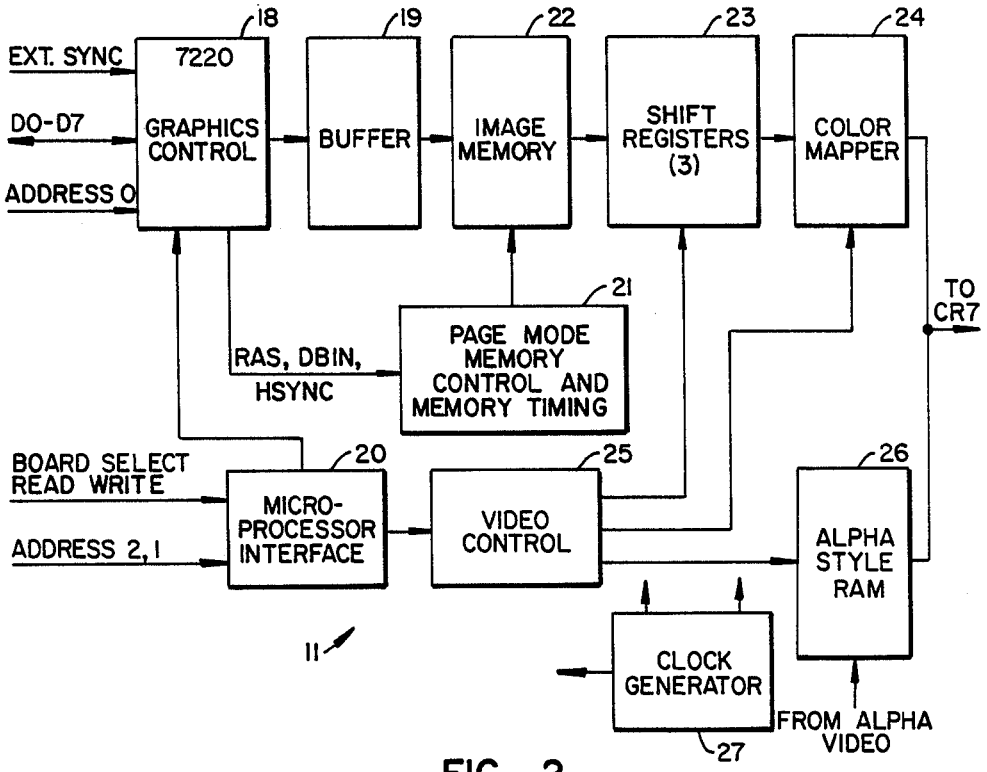
FIG. 2 is a block diagram of a color work station graphics hardware architecture according to the present invention.

The present invention relates to graphic display control circuit 11, the architecture of which is shown in block form in FIG. 2. In FIG. 2, a graphics control integrated-circuit 18, such as the 7220 manufactured by NEC of Japan, is interfaced to system CPU 12 (FIG. 1) from which it receives synchronization signals (EXT. SYNC), control signals (ADDRESS 0), and by which bi-directional communications are provided between the CPU and the graphics control circuit over a data bus (D0–D7).

A microprocessor interface circuit 20 is also connected to CPU 12. Signals received at microprocessor interface 20 include device control (address 2,1) and mode control (BOARD SELECT, READ, WRITE). Microprocessor interface 20 in turn provides control signals to graphics control chip 18 and to a video control circuit 25.

Video control circuit 25 coordinates operation of a shift register circuit 23, a color mapper circuit 24, and an alpha style RAM 26. Graphics display control circuit synchronization is controlled by a clock generator circuit 27.

Data received from CPU 12 by the graphics control chip 18 is used to update and otherwise operate the graphics display control circuit. Resulting information is routed through a buffer circuit 19 and provides both address information and data to an image memory 22. Page mode operation of image memory 22 is controlled by page mode memory control and memory timing circuit 21.

In the exemplary embodiment of the invention, image memory 22 is an array of sixteen 64K dynamic RAMs, such as the HM 4164-2 manufactured by Hitachi of Japan. Each memory chip in the array is partitioned into three planes, under control of page mode memory control circuit 21. As each memory plane is accessed, it is stored in shift register circuit 23 until all planes have been read from memory.

Under direction of video control circuit 25 the multi-plane image information is provided to color mapper circuit 24 and thence to the CRT display. Alphanumeric video information is provided to alpha style RAM circuit 26 which contains a library of characters and textual functions. Display of graphics and alpha characters is a function of CPU control. Priority is assigned at each display pixel location as is appropriate according to selected conventions.

Figure 3A:
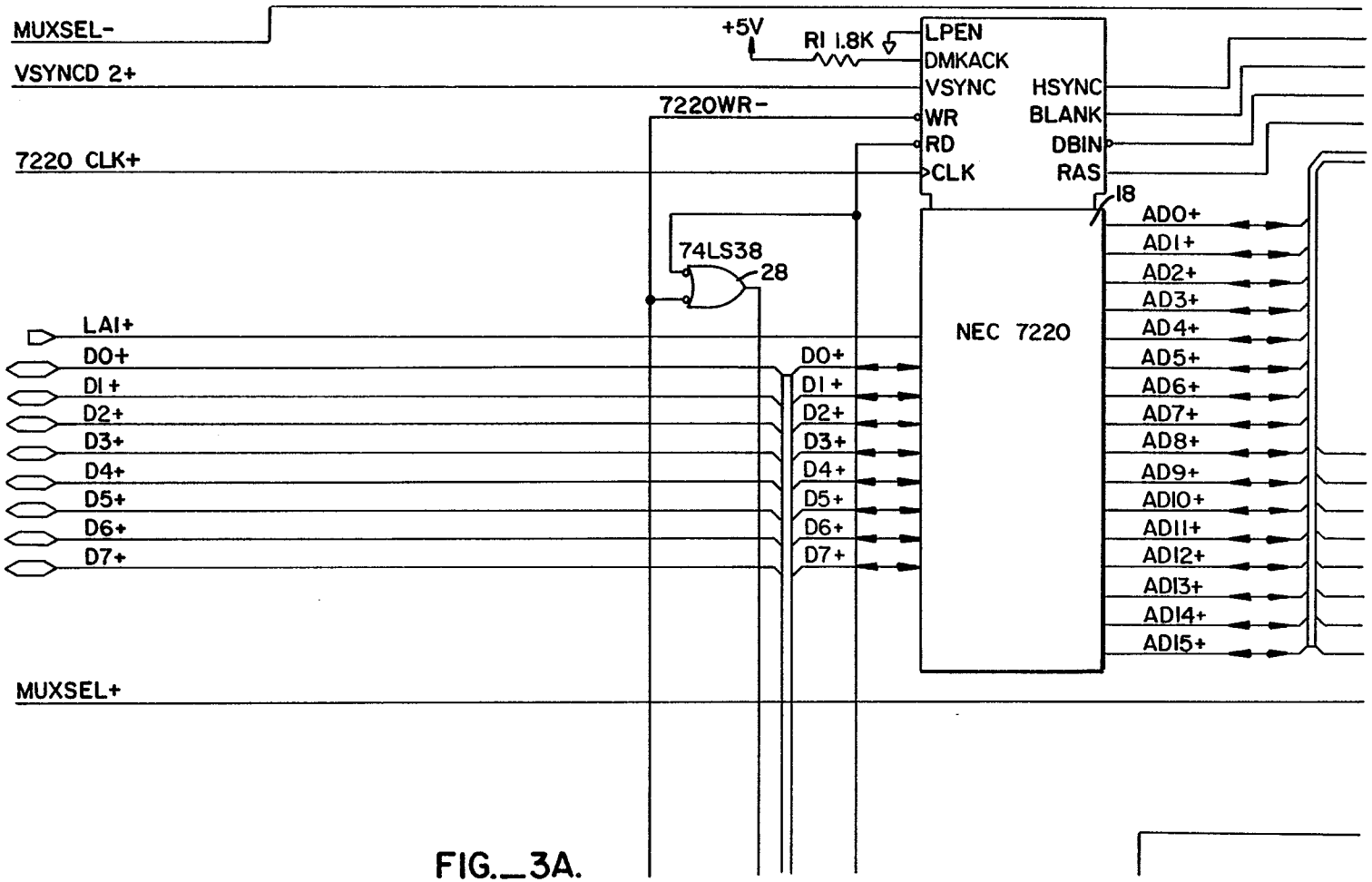
FIG. 3A is a schematic diagram of a graphics control circuit according to the present invention.

FIG. 3A is a schematic representation of graphics control integrated circuit 18. It can be seen in FIG. 3A that system information exchange between the CPU and the graphics control circuit is accomplished over a data bus (D0–D7). A NOR gate 28 is provided to sense read or write mode of the graphics control circuit and produce an appropriate signal output (see FIG. 3C).

Figure 3B:
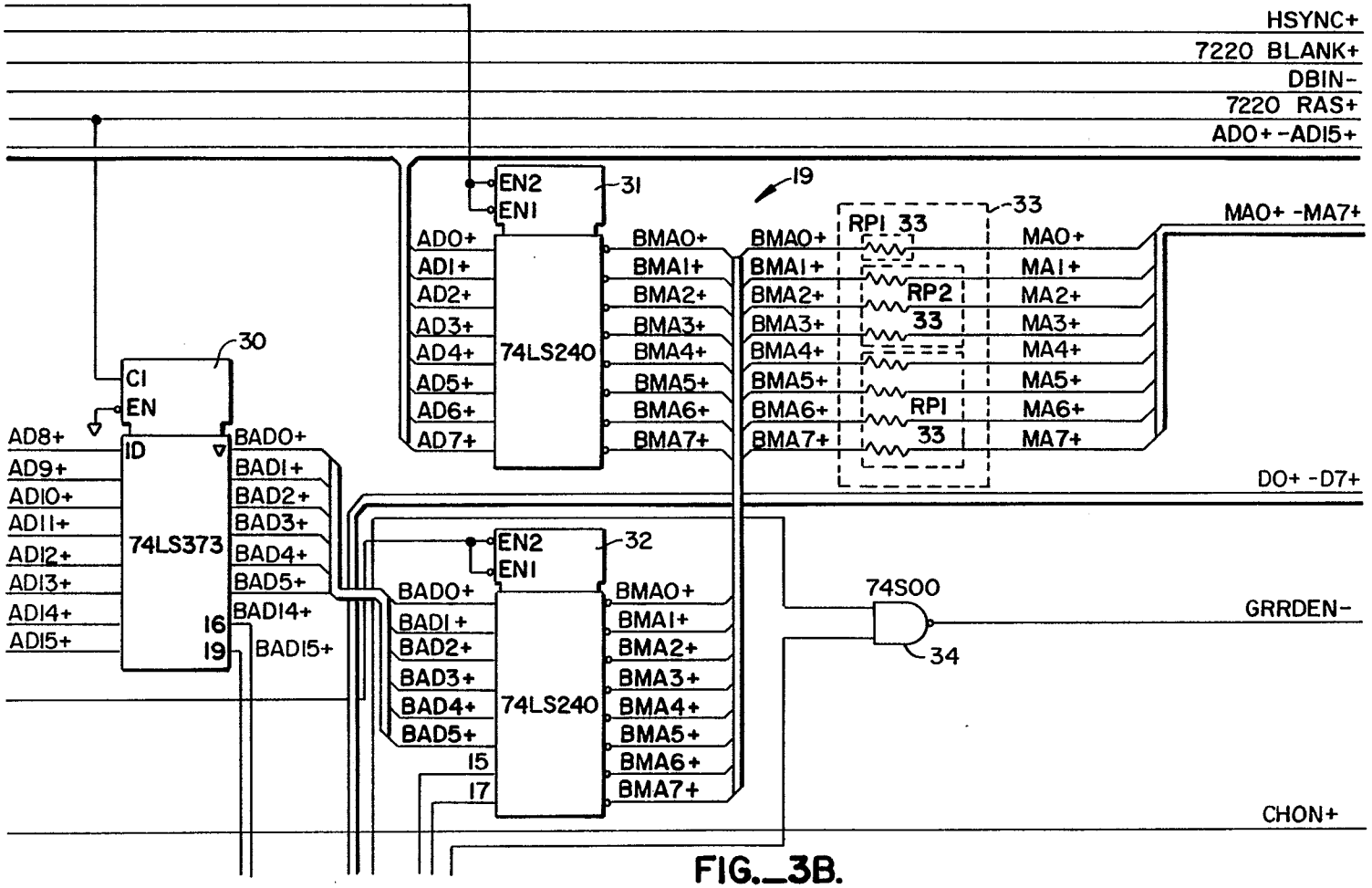
FIG. 3B is a schematic diagram of a buffer circuit for the graphics control circuit of FIG. 3A.

Graphics control circuit 18 provides an internal bus for the graphics display control circuit 11 comprising 16 bits (AD0–AD15). Referring to FIG. 3B, it can be seen that bus lines AD0–AD7 are provided to a first buffer 31 and that bus lines AD8–AD15 are provided to a second buffer 30.

The output of buffer 31 (BMA0–BMA7) is provided to a resistor network 33. The output of buffer 30 (BAD-0–BAD5) is provided to a buffer circuit 32. The output of buffer circuit 32 (BMA0–BMA7) is also provided to resistor network 33. The buffer output routed through resistor network 33 comprises a memory address bus (MA0–MA7).

Pins 16 and 19 of buffer 30 (BAD14+ and BAD15+) define the two most significant bits of the memory address which is routed over the memory address bus (MA0–MA7). Referring to FIG. 3D, it can be seen that the pin 16/19 output of buffer 30 is coupled to a counter circuit 42. The output of counter circuit 42 is in turn coupled to pins 15 and 17 of buffer 32.

Memory addresses are multiplexed. That is, a 16-bit memory address is provided as two 8-bit addresses, one after the other, on an eight bit bus (MA0–MA7). A first portion of the address (usually, the least significant bit portion) is thus provided by buffer 31 which is enabled by the MUX SEL−signal. The second (most significant bit) portion of the memory address is provided by buffer 32, which is enabled by the MUX SEL signal. Counter circuit 42 may be operated to be transparent to a preload value from pins 16/19 of buffer 30, or it may be incremented under control of the CNTCK+signal.

The memory devices used in the exemplary embodiment of the present invention require both a row and a column address. The design of the memory circuit provides only one bus. Buffers 31 and 32 provide the row address and a column address to image memory 22 (discussed below).

Figure 3C:
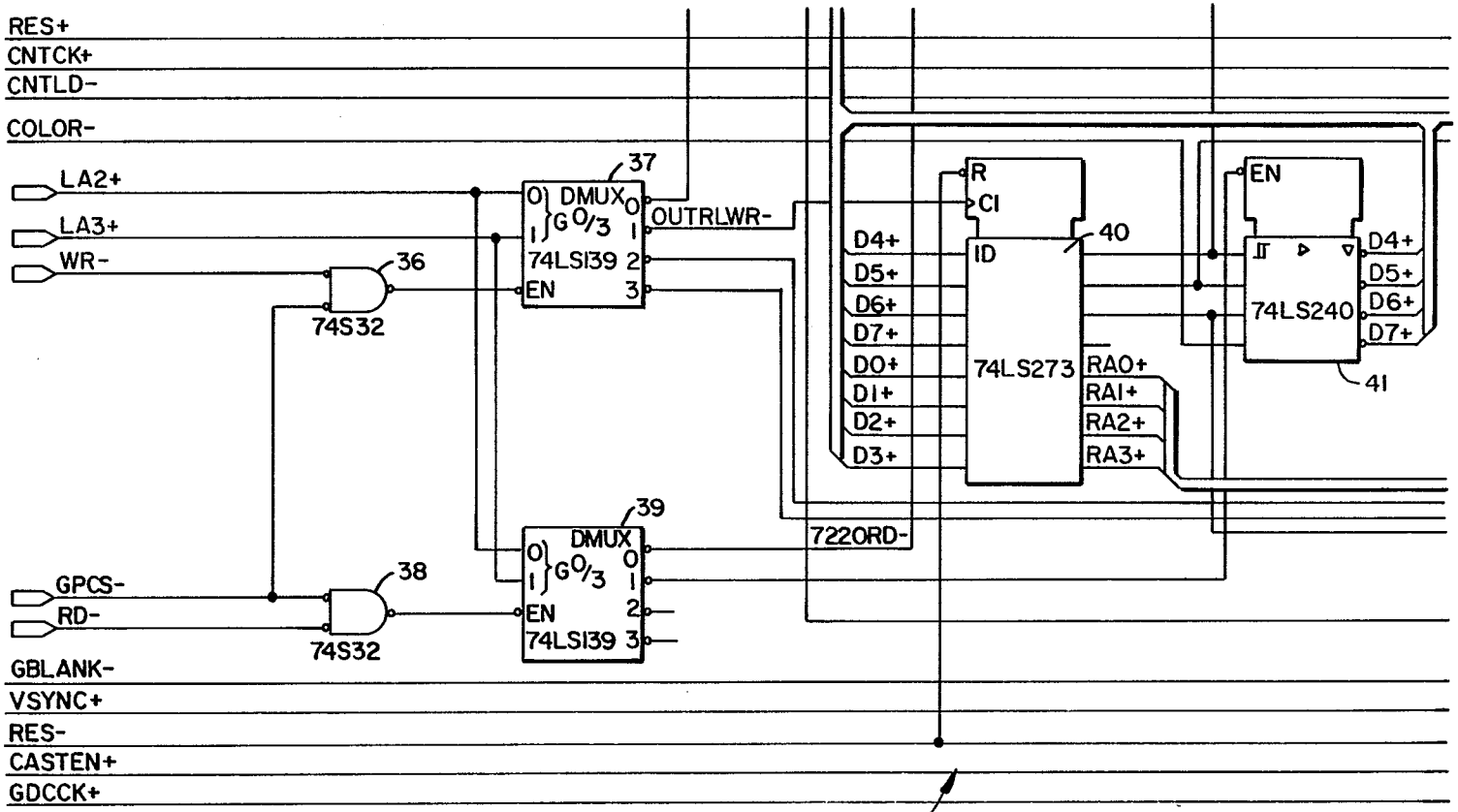
FIG. 3C is a schematic diagram of a microprocessor interface; and a graphics/character select register.
Figures 3, 3A, 3B, 3C, 3D:
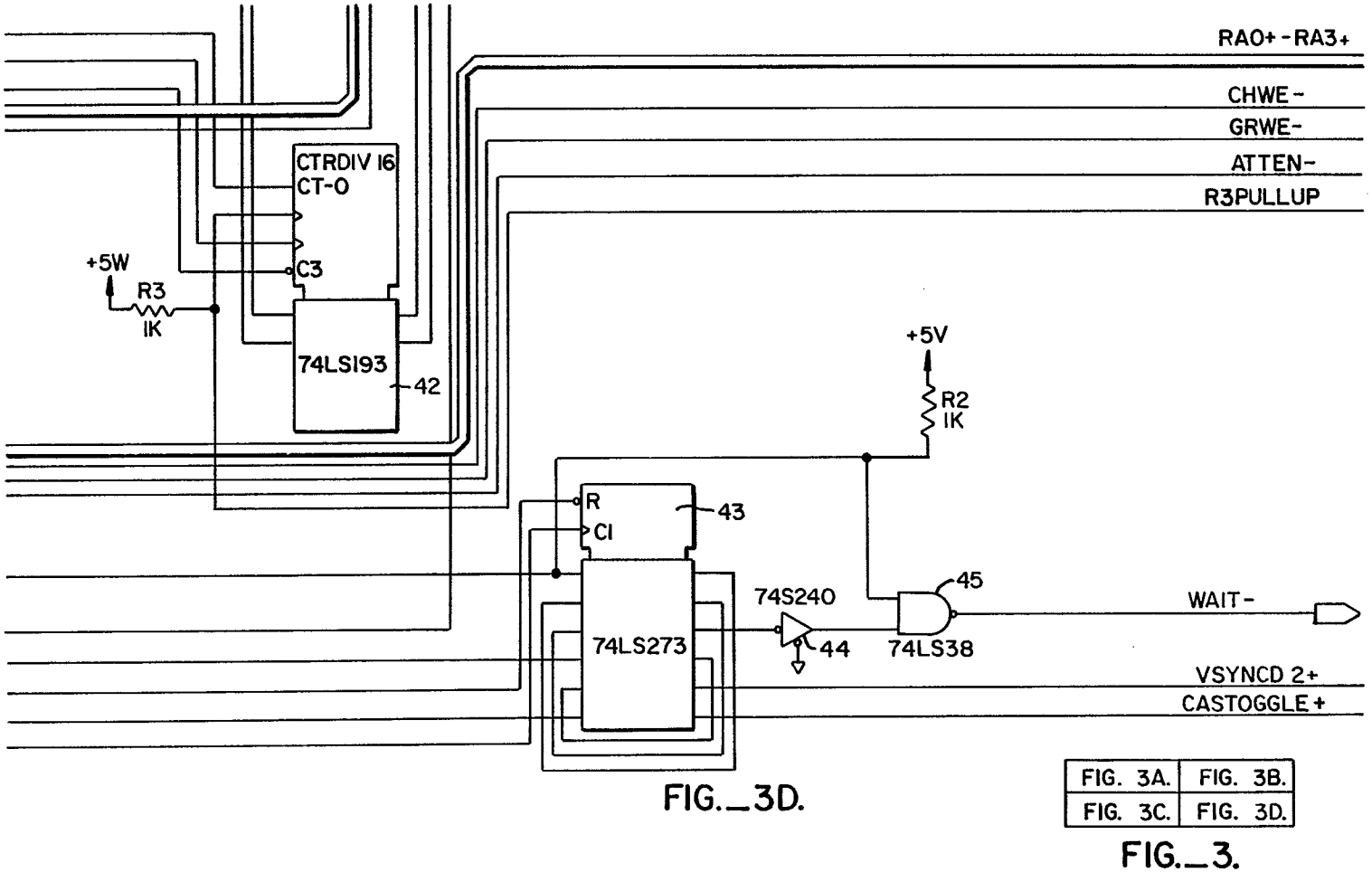
FIG. 3D is a and counter for generating the two least significant bits of a memory column address.

FIG. 3C shows in schematic form additional circuitry for interfacing the graphics display control circuit to a system CPU, such as CPU 12. A graphic/character write detect enable circuit comprising an OR gate 36 and a decoder circuit 37 is provided. Similarly, a graphic/character read enable detect circuit, comprising an OR gate 38 and a decoder circuit 39 is also provided. The microprocessor interface circuit includes a graphic character select circuit 40 which is coupled to the data bus (D0–D7), and by which graphic and character display selection is made.

The output of register 40 is provided to a data buffer circuit 41. Additionally, a display control decoder circuit 43 is provided by which various display and CPU interface signals are produced. For example, an output of circuit 43 is provided through an inverter 44 and a NAND gate 45 in the form of a WAIT−signal, which holds off the CPU until the 7220 is finished responding to the current command.

Figure 4:
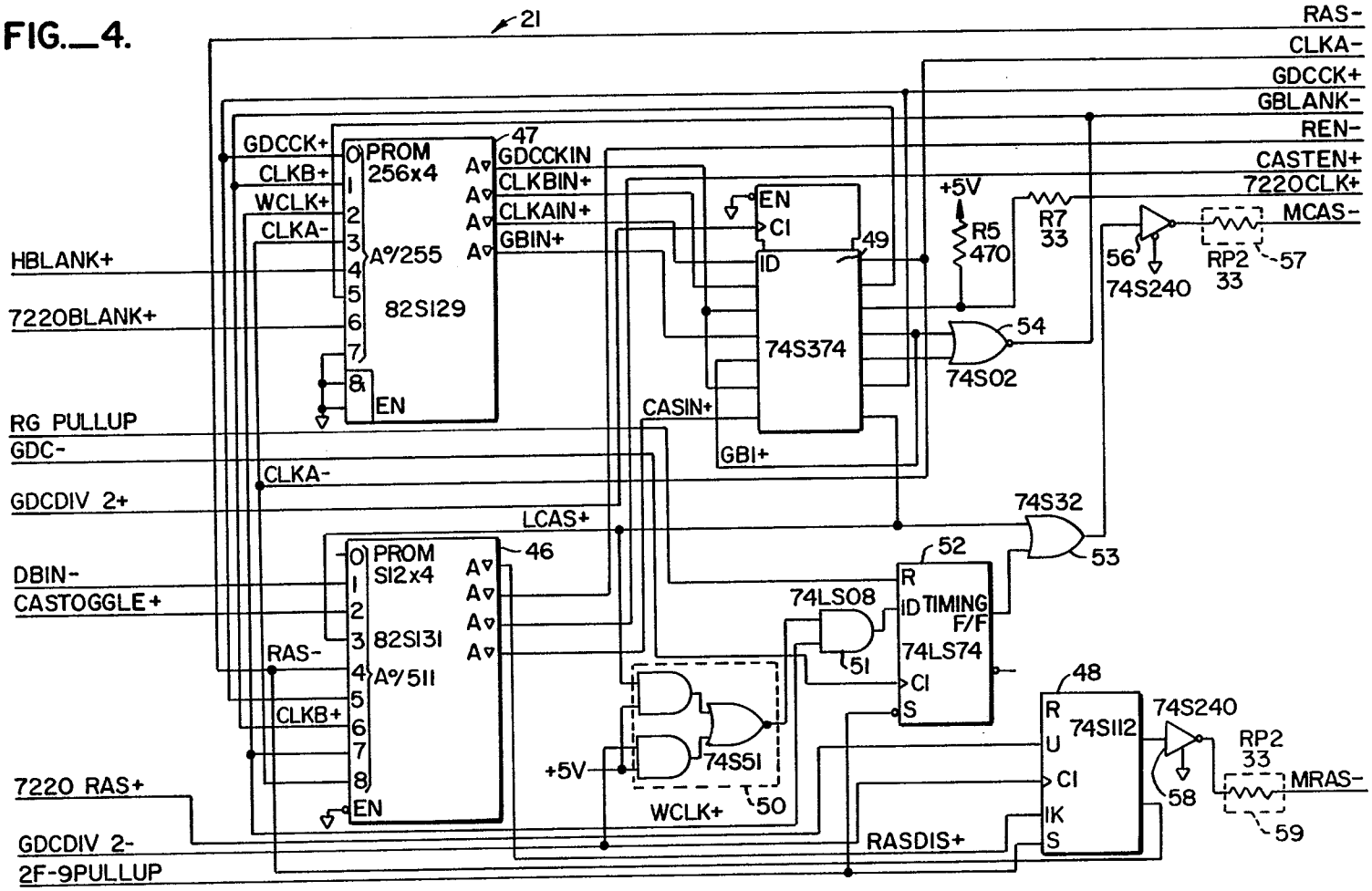
FIG. 4 is a schematic diagram of a page mode memory control and memory timing circuit according to the present invention.

Referring now to FIG. 4, page mode memory control and memory timing circuit 21 is shown in schematic form. A memory access sequence is controlled by the memory row address strobe (MRAS) and memory column address strobe (MCAS) signals. In the exemplary embodiment of the invention the MRAS and MCAS signals are produced at appropriate times (see FIG. 7) in response to signals output from a control PROM 46. PROM 46 operates in such manner that appropriate signals are produced as outputs in response to corresponding inputs (0–8). The inputs to PROM 46 are derived from various display control signals and memory control signals produced by graphics control circuit 18. A code listing of PROM 46 next-state generation is provided as an Appendix to this document.

Figures 5, 5A:
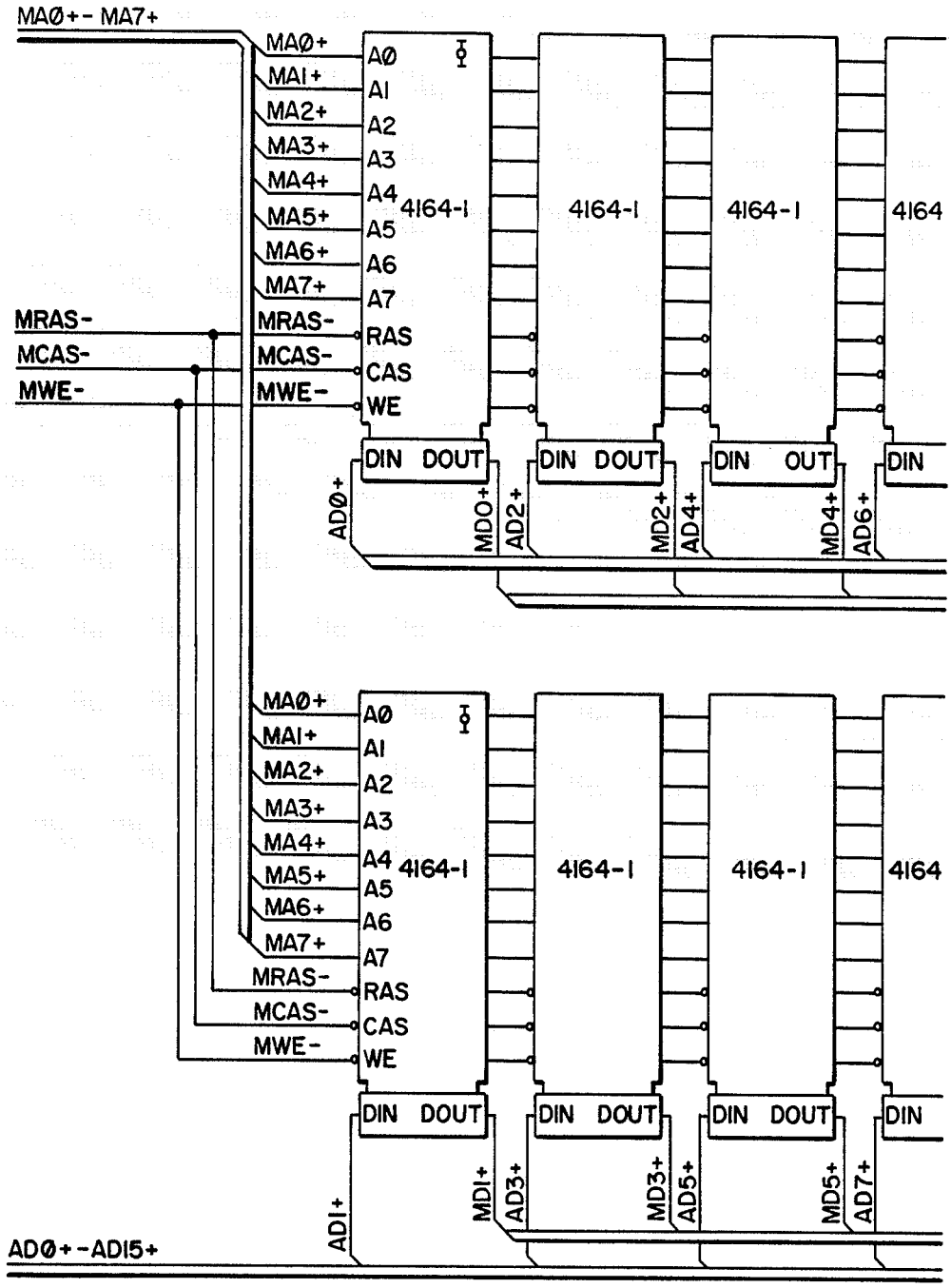
FIGS. 5, 5A and 5B are schematic diagrams of a graphic image memory according to the present invention.
Figure 5B:
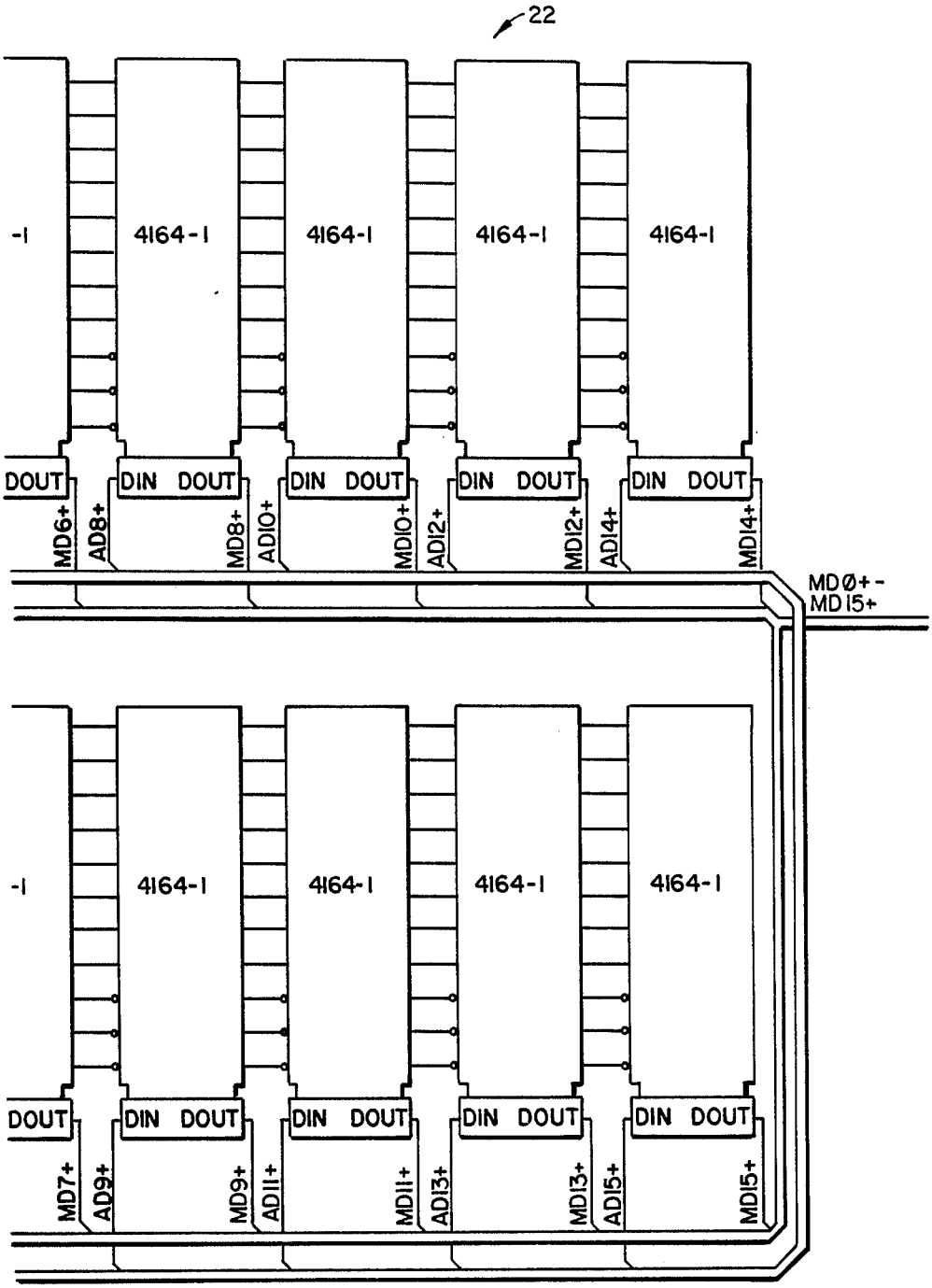

The MRAS signal is first produced in response to a control PROM 46 output received at a flip flop 48. The output of flip flop 48 is coupled through a tri-state buffer 58 and a resistor 59 and thereafter to the memory (FIG. 5).

The MRAS signal is produced coincidental with a memory row address, and is used to latch a row address in the memory array (as discussed below). After the MRAS sequence, control PROM 46 provides an output to a control register circuit 49. The output of control register circuit 49 is provided to an OR gate 53 and thence, through a tri-state buffer 56 and a resistor 57, to the memory array, as the MCAS signal.

In order to accomplish pagination of the memory, a series of MCAS signals must be produced during a memory access cycle (defined to be an MRAS memory access+N MCAS memory access signals). Each MCAS signal produced accesses a different page of memory which, in turn, provides a different display plane. In the exemplary embodiment of the invention, the two most significant bits of the memory column address (as controlled by counter 42) provides four possible display planes. In the particular embodiment of the invention being disclosed, three of these four planes are used.

To separate the MCAS signal into a series of MCAS signals during a memory access cycle, a signal from control PROM 46 is provided to a logic circuit 50, an AND gate 51, and a timing flip-flop 52. The output of flip-flop 52 is routed through an OR gate 53 along with the MCAS signal produced at control PROM 46. The signal is then routed as described above to the memory array.

FIG. 4 also shows a display control PROM 47 (an Appendix is included with this document which contains a listing of display control PROM 47 code). The output of PROM 47 is supplied to a display control register 49 and provides various synchronizing signals for maintaining proper operation of the CRT display. A NAND gate 54 is also provided to produce, at appropriate times, a graphic blanking signal.

FIG. 5 is a schematic representation of a memory array 22 containing sixteen Hitachi 4164-1 64K dynamic RAMs. A 16-bit memory address, consisting of an 8-bit memory row address followed by an 8-bit memory column address, is provided to the memory over memory address bus MA0–MA7. The individual memory chips are connected to the bus in parallel such that the same rows and columns are accessed in each memory during a memory access cycle. Data may be written into the memory via 16-bit data bus AD0–AD15 when the write enable signal (MWE−) is present.

When a read operation is performed (page mode) data output from the memory array are provided on memory data bus MD0–MD15. Each chip in the memory array may receive or provide one bit of information per plane during a memory access cycle.

A memory write operation is controlled by the write enable line as discussed above. A memory page mode read is controlled by the MRAS and MCAS lines as follows: An MRAS signal is provided to the memory array, indicating that a row address is present on the memory address bus. The memory chips are designed such that any address present on the memory address bus, coincident with the MRAS signal, is latched into memory when the MRAS signal is removed.

Once the memory row address is selected, the memory address bus couples a memory column address to the memory array. A first memory column address, corresponding to a first page or display plane is provided coincident with a first MCAS signal. After the MCAS signal is removed, counter 42 is incremented by 1, thereby incrementing the most significant two bits of the memory column address.

A second MCAS signal is then provided, thereby accessing a second page or display plane of data. The MCAS signal is then removed, the most significant two bits of the memory column address is once again incremented by one, and a third MCAS signal is provided, thereby providing a third page or display plane to or from memory. Generation of the MCAS and MRAS signal is best seen by referring to the timing diagram of FIG. 7.

Operation of the exemplary embodiment of the present invention therefore involves selection of a memory row and subsequent selection of three memory columns, each column in a different plane of memory. Because a memory array of sixteen 64K RAMs is provided, each memory access cycle produces a multiplane 16-bit word wherein each bit corresponds to a display pixel location and wherein the three planes at each pixel location may be used to select one of eight colors to be displayed at that location. That is, 16-bits are provided in parallel, three planes or bits deep. The assignment of three bits to a pixel provides $2^3$ or 8 possible combinations at each pixel location. It will be appreciated that although the exemplary embodiment controls three planes of color, the three bits could easily be used to control a gray scale or to control three separate graphic display planes, each display plane defining a different image to be displayed. Additionally, the memory array could be made larger or smaller, depending on the complexity of the control system. Furthermore, more than three bits or planes (pages) of information could be provided at each location as desired.

Figure 6A:
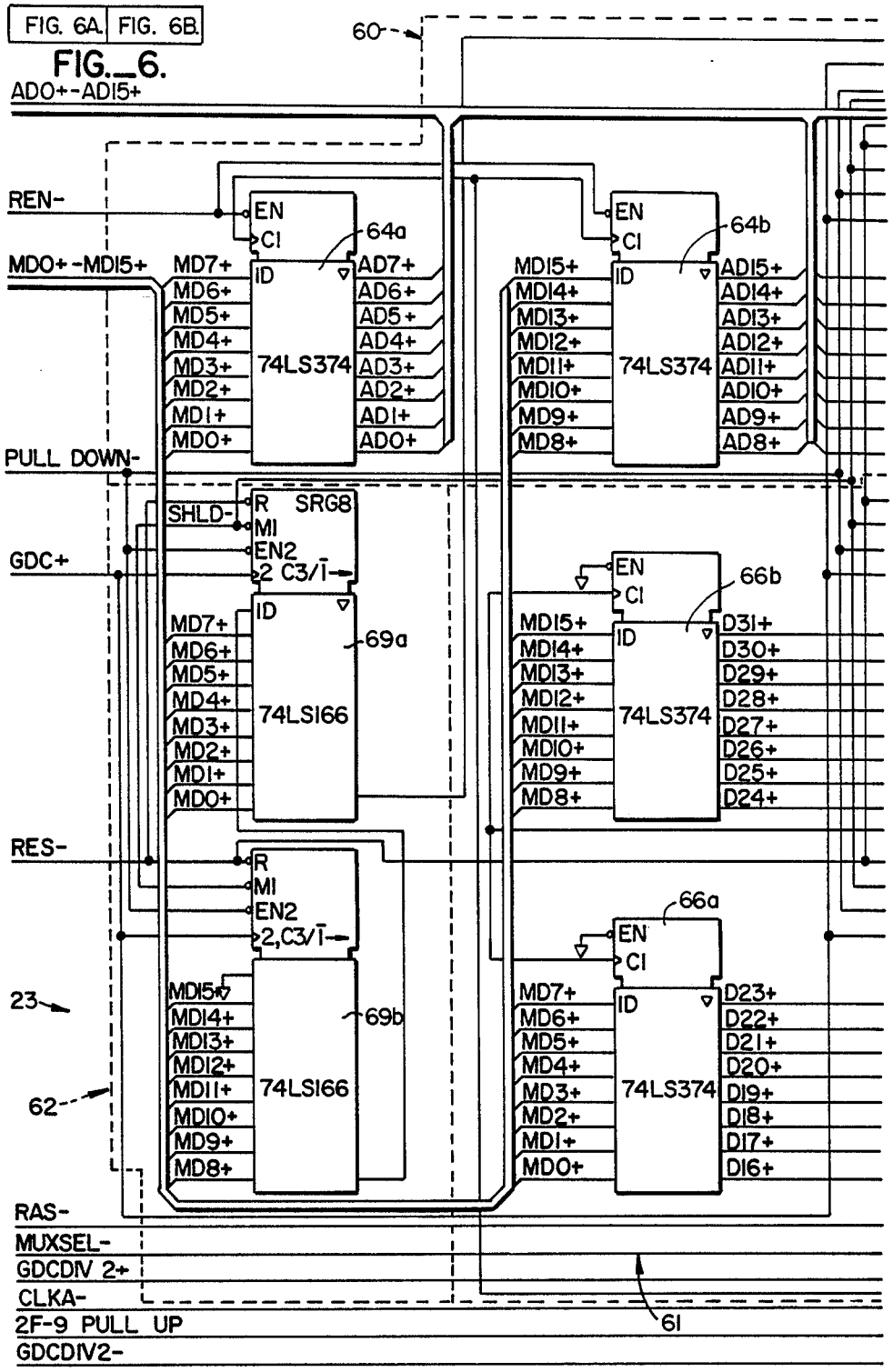
Figure 6B:
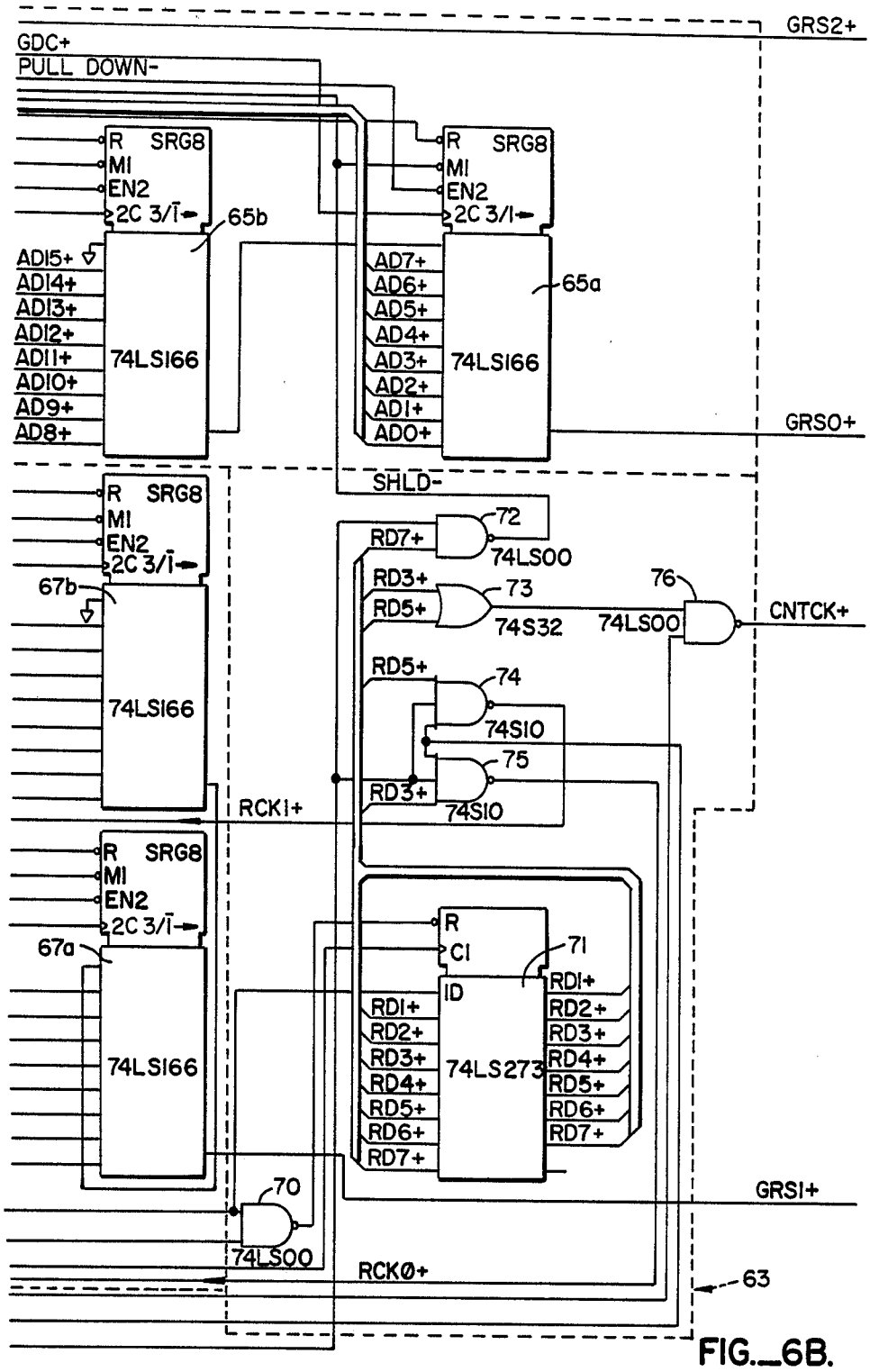

FIG. 6 is a schematic representation of register 23. Because the three pages are read from memory sequentially, but control a display simultaneously, the first two pages of memory must be stored. The 16-bits memory output (MD0–MD15) is provided as three separate 16-bit words. The first page output (16-bit word) is provided to a register/buffer 60 which includes a latching buffer circuit 64A/64B and a shift register circuit 65A/65B.

The second page (16-bit word) output from memory is provided to a register/buffer 61 which includes a latching buffer 66A/66B, and to a register circuit 67A/67B. The third page (16-bit word) output from memory is provided to a register 62 comprising a shift register 69A/69B. Because there is no need to store the third page of memory (it can be shifted directly to the display along with the other two, stored planes), shift register circuit 62 does not include a latching buffer stage.

Operation of shift registers 60, 61, and 62 is under control of a shift register plane timing control circuit 63. Shift register 60 is enabled to receive the first page of memory by the RCK0 signal produced at a NAND gate 75 in response to control signals from a register 71 and a NAND gate 70. Once the first page from memory is stored in shift register 60, the RCK0 signal is removed and the RCK1 signal is provided from a NAND gate 74 in a manner similar to that by which the RCK0 was provided. The RCK1 signal enables shift registers 61. In this way, the second page from memory is loaded into the shift register. The third page of memory is then loaded into shift register 62. A shift load (SHLD−) is produced at a NAND gate 72 and is used to shift the three pages of memory out of the three associated shift registers simultaneously. The three 16-bit parallel pages are shifted out bit-by-bit to form three serial bit streams present at GRS0, GRS1, and GRS2. The three bit streams are then routed to the color mapper circuit (which is a type of circuit well known in the art), combined with an alpha signal according to a priority scheme, converted from a digital signal to an analog video signal, and finally, displayed on a CRT. FIG. 6 shows the count clock (CNTCK+) signal which is produced by an OR gate 73 and a NAND gate 76 in response to various signals provided by shift register 71.

Figure 7:
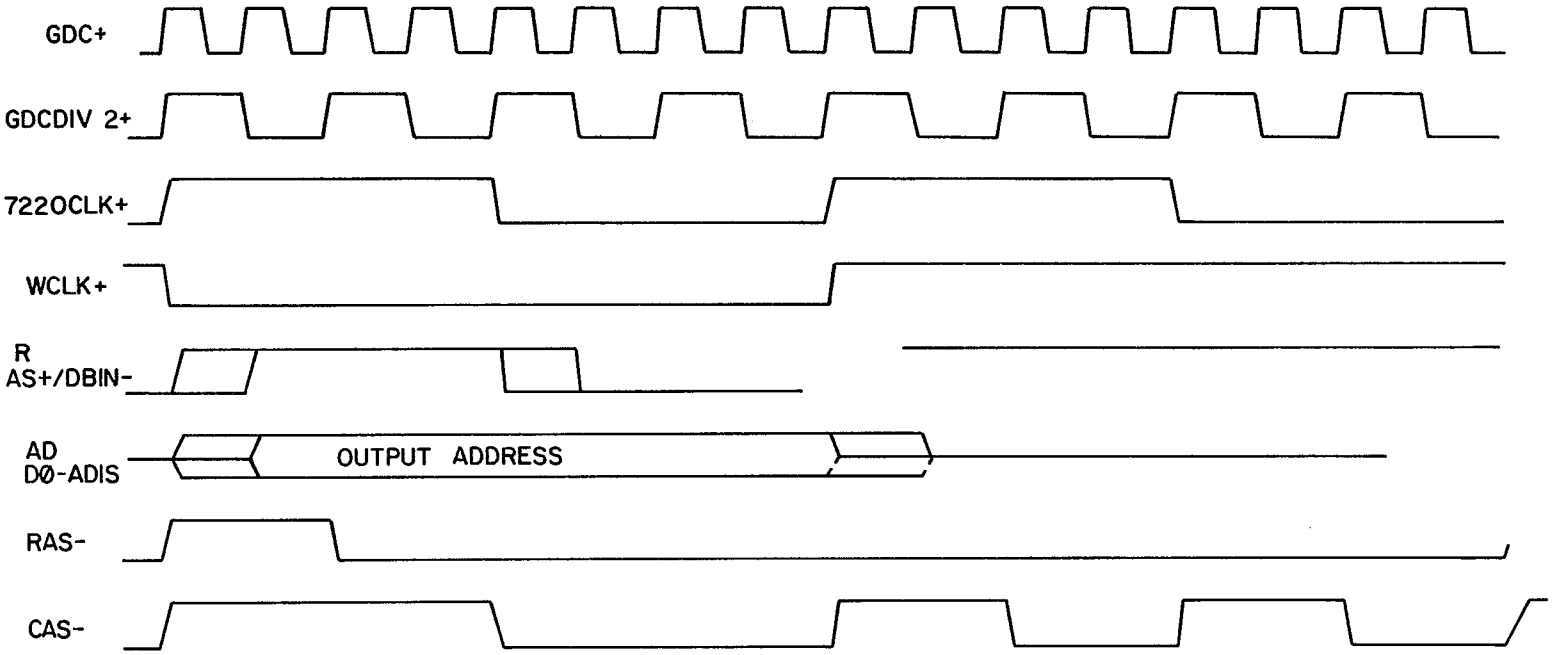
FIG. 7 is a timing diagram showing graphic image memory access in a page memory according to the present invention.

Referring now to FIG. 7, a graphics control clock signal is shown (GDC+). Additional timing signals include the graphics control clock divide by two (GDCDIV 2+), the 7220 CLK+signal, the word clock signal (WCLK+), various address signals, the RAS signal, and the CAS signal. It will be appreciated that relationships expressed in the timing diagram of FIG. 7 apply only to the exemplary embodiment of the invention set forth herein. The present invention may be produced with other timing relationships without departing the scope and spirit of the invention. For example, additional CAS signals could be produced during a memory access cycle, thereby producing additional pagination within the memory and providing additional display planes. It will be appreciated that while casual reference has been made to various display control circuits (vertical, horizontal, blanking, etc.) throughout this discussion, such reference is made with the understanding that such display control circuits are well known in the art and may be of any of the types of circuits commonly in use for operating a display.

Because the present invention is subject to production in various embodiments, the foregoing was given by way of illustration and example. Therefore, the scope of the invention should be limited only by the breadth of the claims.

APPENDIX I

| ADDRESS(ES) (HEX) | CONTENTS (HEX) |
|---|---|
| 0–1F | A |
| 20–2F | 8 |
| 30–3F | 2 |
| 40–88 | A |
| 89 | 8 |
| 8A | 3 |
| 8B | 1 |
| 8C–8D | 0 |
| 8E | 1 |
| 90–127 | A |
| 128 | 8 |
| 129–14A | A |
| 14B | 6 |
| 14C–172 | 8 |
| 173 | 2 |
| 174–186 | 8 |
| 187–1AE | A |
| 1AF–1C9 | 2 |
| 1CA–1CC | 3 |
| 1CD | 0 |
| 1CE–1CF | 1 |
| 1DO–1FF | A |

APPENDIX II

| ADDRESS (HEX) | CONTENTS (HEX) | ADDRESS (HEX) | CONTENTS (HEX) | ADDRESS (HEX) | CONTENTS (HEX) |
|---|---|---|---|---|---|
| 0 | 6 | 31 | 4 | 62 | 9 |
| 1 | D | 32 | 1 | 63 | D |
| 2 | 1 | 33 | 5 | 64 | E |
| 3 | 5 | 34 | 1 | 65 | C |
| 4 | 6 | 35 | 0 | 66 | 9 |
| 5 | 4 | 36 | 1 | 67 | D |
| 6 | 1 | 37 | 0 | 68 | E |
| 7 | 5 | 38 | 6 | 69 | 4 |
| 8 | E | 39 | 4 | 6A | 7 |
| 9 | C | 3A | 1 | 6B | 5 |
| A | F | 3B | 5 | 6C | 6 |
| B | D | 3C | E | 6D | 4 |
| C | 6 | 3D | C | 6E | F |
| D | C | 3E | F | 6F | 5 |
| E | 7 | 3F | D | 70 | 9 |
| F | D | 40 | E | 71 | 0 |
| 10 | 6 | 41 | D | 72 | 9 |
| 11 | 4 | 42 | 9 | 73 | 8 |
| 12 | 1 | 43 | D | 74 | 9 |
| 13 | 5 | 44 | E | 75 | 0 |
| 14 | 9 | 45 | C | 76 | 9 |
| 15 | 8 | 46 | 9 | 77 | 0 |
| 16 | 1 | 47 | D | 78 | E |
| 17 | 5 | 48 | E | 79 | C |
| 18 | E | 49 | C | 7A | 9 |
| 19 | C | 4A | F | 7B | D |
| 1A | 9 | 4B | D | 7C | E |
| 1B | D | 4C | E | 7D | C |
| 1C | 6 | 4D | C | 7E | 9 |
| 1D | 4 | 4E | F | 7F | D |
| 1E | 1 | 4F | D | 8F-1FF | F |
| 1F | 5 | 50 | 9 | | |
| 10 | E | 51 | 8 | | |
| 21 | C | 52 | 1 | | |
| 22 | 9 | 53 | 0 | | |
| 23 | D | 54 | 9 | | |
| 24 | E | 55 | 8 | | |
| 25 | C | 56 | 1 | | |
| 26 | 9 | 57 | 0 | | |
| 27 | D | 58 | E | | |
| 28 | 6 | 59 | C | | |
| 29 | 4 | 5A | 9 | | |
| 2A | 2 | 5B | D | | |
| 2B | 5 | 5C | 6 | | |
| 2C | 6 | 5D | 4 | | |
| 2D | 4 | 5E | 7 | | |
| 2E | 7 | 5F | 5 | | |
| 2F | 5 | 60 | E | | |
| 30 | 6 | 61 | C | | |

What is claimed is:

1. A page mode memory controller for accessing a dynamic random access memory (RAM), comprising:

means for accessing a selected memory row address;

means for latching said selected memory row address during a memory access interval;

means for providing a selected most significant (MS) memory column address portion;

means for providing a selected least significant (LS) memory column address portion;

means for combining said MS and said LS memory column address portions and for periodically accessing a corresponding memory column address during said memory access interval; and a counter for sequentially incrementing said LS memory column address portion, in coordination with said periodic memory column address access, wherein a plurality of memory column addresses are accessed during said memory access interval, locating a plurality of corresponding sequential memory pages.

2. The memory controller of claim 1, further comprising:

means for selectably entering data into, and retrieving data from, memory locations defined by an intersection of said memory row and column addresses.

3. The memory controller of claim 2, further comprising an array of RAMs.

4. In a multi-plane video graphic display, a page mode memory controller for accessng a dynamic random access memory (RAM) image memory array, comprising:

a graphics controller for generating in sequence:

(a) a memory row address signal;

(b) a memory row strobe signal, wherein said address signal is latched into each memory element in said image memory array during a memory access period; and thereafter (c) a most significant (MS) portion of a memory column address signal;

a counter for generating a least significant (LS) portion of a memory column address signal;

means for combining said MS portion and said LS portion of said memory column address signal;

means for generating a memory column strobe signal at spaced intervals during said memory access period after generation of said memory row strobe signal; and means for sequentially incrementing said counter coincident with each generation of said memory column strobe signal, wherein a plurality of sequential image memory array pages are accessed during said memory access period, each page corresponding to one of said video display planes.

5. The memory controller of claim 4, further comprising:

means for selectably entering data into, and retrieving data from, memory array locations defined by an intersection of said memory row and column addresses.

6. The memory controller of claim 5, further comprising:

a shift register for sequentialy storing said image memory array pages, one in parallel with the other, during said memory access period, and for subsequently providing a simultaneous serial bit stream output for each of said image memory array pages, each serial bit corresponding to a discrete display pixel location.

7. The memory controller of claim 6, said image memory array comprising a plurality of dynamic RAMs.

8. The memory controller of claim 7, further comprising:

a memory address bus linking said graphics controller and said counter with said memory array and over which said memory row address signal is first provided to said memory array and, thereafter, said memory column address signal is provided to said memory array, during each memory access period.

9. The memory controller of claim 8, each of said video display planes comprising a display color or intensity attribute.

10. The memory controller of claim 9, further comprising:

a color mapper for simultaneously receiving each of said shift register serial output bit streams and for assigning color or intensity attributes to each corresponding display pixel location in accordance therewith.

11. The memory controller of claim 10, further comprising:

means for converting said serial bit streams and corresponding assigned color attributes into an analog video signal.

12. A memory controller of claim 4, said video graphics display further comprising an alphanumeric display.

13. A method for accessing a dynamic random access memory (RAM), comprising:

accessng a selected memory row address;

latching said selected memory row address during a memory access interval;

providing a selected most significant (MS) memory column address portion;

providing a selected least significant (LS) memory column address portion;

combining said selected MS and LS memory column address portions;

periodically accessing a memory column address corresponding to said combined MS and LS memory column address portions during said memory access interval; and sequentially incrementing said LS address portion in coordination with said periodic memory column address access, wherein a plurality of memory column addresses are accessed during said memory access interval, locating a plurality of corresponding sequential memory pages.

14. The method of claim 13 further comprising:

selectably entering data into, and retrieving data from, memory locations defined by an intersection of said memory row and column addresses.

15. In a multi-plane video graphics display, a method for accessing a dynamic random access memory (RAM) image memory array, comprising:

generating a memory row address signal;

generating a memory strobe signal, wherein said address signal is latched into each memory element in said image memory array during a memory access period;

generating a most significant (MS) portion of a memory column address;

generating a least significant (LS) portion of a memory column address;

combining said MS portion and said LS portion of said memory column address signal;

generating a memory column strobe signal at spaced intervals during said memory access period after generation of said memory row strobe signal; and sequentially incrementing said LS memory column address signal portion coincident with each generation of said memory column strobe signal, wherein a plurality of sequential image memory array pages are accessed during said memory access period, each page corresponding to one of said video display planes.

16. The method of claim 15, further comprising:

selectably entering data into, and retrieving data from, memory array locations defined by an intersection of said memory row and column addresses.

17. The method of claim 16, further comprising:

sequentially storing said image memory array pages, one in parallel with the other, during said memory access period; and subsequently providing a simultaneous serial bit stream output for each of said image memory pages, each serial bit corresponding to a discrete display pixel location.

18. The method of claim 17, further comprising:

assigning color or intensity attributes to each corresponding display pixel location of said serial bit streams.

19. The method of claim 18, further comprising:

converting said serial bit streams and corresponding assigned color or intensity attributes into an analog video signal.

20. In a multi-plane video graphics display, a method for accessing a dynamic random access memory (RAM) image memory array, comprising:

generating a memory row address signal;

latching said memory row address signal into said memory array with a memory row address strobe signal;

removing said memory row address signal;

generating a first memory column address strobe signal;

generating a most significant portion (MS) of a memory column address signal;

generating a least significant (LS) portion of a memory column address signal;

combining said MS and said LS portions of said memory column address signal;

accessing a first memory array location defined by an intersection of said memory row and column addresses;

storing data contained at said memory array location in a buffer;

removing said first memory column address strobe signal;

incrementing said LS portion of said row address signal;

generating a second memory column address strobe signal;

accessing a second memory location defined by an intersection of said memory row and incremented column addresses;

removing said second memory column address strobe signal; and serially shifting the data stored in said buffer from said buffer while simultaneously shifting data from said second memory location, to form two bit streams corresponding to a plurality of sequential display pixel locations having color or intensity attributes selected by the combined, multiple bit stream data.

21. The method of claim 20, further comprising:

further incrementing said LS portion of said memory column address signal and subsequently accessing a corresponding memory location a plurality of times, corresponding to a desired number of display planes.

* * * * *